US010527066B2

(12) United States Patent
Smith

(10) Patent No.: US 10,527,066 B2
(45) Date of Patent: Jan. 7, 2020

(54) APPARATUS TO TRANSMIT AXIAL FORCE TO A SNUBBING UNIT'S SLIP ASSEMBLY, INCLUDING DURING ROTATION

(71) Applicant: SNUB EQUIPMENT LTD., Olds (CA)

(72) Inventor: Nathan Smith, Olds (CA)

( * ) Notice: Subject to any disclaimer, the term of this patent is extended or adjusted under 35 U.S.C. 154(b) by 0 days.

(21) Appl. No.: 16/024,842

(22) Filed: Jun. 30, 2018

(65) Prior Publication Data

US 2019/0003493 A1 Jan. 3, 2019

Related U.S. Application Data

(60) Provisional application No. 62/528,015, filed on Jun. 30, 2017.

(30) Foreign Application Priority Data

Jun. 30, 2017 (CA) ..... 2972130

(51) Int. Cl.

| | |
|---|---|
| ***E21B 3/04*** | (2006.01) |
| ***E21B 19/07*** | (2006.01) |
| ***E21B 19/10*** | (2006.01) |
| ***F15B 7/08*** | (2006.01) |
| ***F15B 15/20*** | (2006.01) |

(52) U.S. Cl.

CPC ..... *F15B 7/08* (2013.01); *E21B 3/04* (2013.01); *E21B 19/07* (2013.01); *E21B 19/10* (2013.01); *F15B 15/20* (2013.01)

(58) Field of Classification Search

CPC . E21B 19/07; E21B 19/10; E21B 3/04; F15B 7/08; F15B 15/20

See application file for complete search history.

(56) References Cited

U.S. PATENT DOCUMENTS

| | | | | |
|---|---|---|---|---|
| 2,545,177 A * | 3/1951 | True | E21B 19/10 188/67 |
| 3,722,603 A * | 3/1973 | Brown | E21B 19/08 173/149 |
| 8,863,846 B2 * | 10/2014 | Overstreet | E21B 19/086 166/338 |

* cited by examiner

*Primary Examiner* — Matthew R Buck

(74) *Attorney, Agent, or Firm* — Sander R. Gelsing

(57) ABSTRACT

In one aspect there is provided an apparatus to transmit hydraulic force to a snubbing unit's traveling slip assembly. The apparatus comprises a first hydraulic power source having a hydraulic connection to the traveling slip assembly, a hydraulic power source actuator to actuate the hydraulic power source to cause it to transmit hydraulic force to or from the traveling slip assembly. Rotation isolation means are provided to rotationally isolate the hydraulic power source actuator from the first hydraulic power source, and to transfers axial and radial loads between the hydraulic power source actuator 65 and the first hydraulic power source. The first hydraulic power source is mounted to the traveling slip assembly so as to co-rotate therewith.

20 Claims, 8 Drawing Sheets

APPARATUS TO TRANSMIT AXIAL FORCE TO A SNUBBING UNIT'S SLIP ASSEMBLY, INCLUDING DURING ROTATION

CROSS REFERENCE TO RELATED APPLICATION

This application is a non-provisional application which claims priority to, and benefit of, U.S. Provisional Patent Application Ser. No. 62/528,015 filed Jun. 30, 2017 and entitled, "APPARATUS TO TRANSMIT AXIAL FORCE TO A SNUBBING UNIT'S SLIP ASSEMBLY, INCLUDING DURING ROTATION", the entirety of which is incorporated herein by reference.

FIELD OF THE INVENTION

This invention relates generally to snubbing units. More particularly, the invention relates to transmitting axial forces to the slip assembly of a snubbing unit while that slip assembly is rotating.

BACKGROUND OF THE INVENTION

The background information discussed below is presented to better illustrate the novelty and usefulness of the present invention. This background information is not admitted prior art.

It is well known to attach a variety of rigs such as hydraulically operated rigs above a wellhead. For example, snubbing units are known in the oil and gas industry for facilitating access to a well which is under pressure including, for example, well operations such as well completions. A snubbing unit includes structure and equipment above a wellhead for manipulating tubular components (or simply "tubulars") such as pipe, tubing, and bottom hole assemblies (BHA) in and out of a well while controlling the well under pressure.

Generally, a snubbing unit employs stationary (lower) and traveling (upper) slip assemblies, opposingly oriented, to releasably and controllably shift tubular components into and out of the well through a wellhead despite the possibility of either heavy tubular loads, which urge the tubular components to fall into the well (also known as "heavy pipe"), or the pressure-generated forces on the tubular components, which urge the tubular components out of the well (also known as "light pipe"). Referring to FIG. 1, the traveling slip assembly may be supported by a jack head, having a traveling plate. In many cases the stationary slip assembly is a dual bowl arrangement with the dual bowls oppositely oriented with slips to hold the tubular component in both axial directions. Likewise, the traveling slip assembly may have a slip bowl with slips that can act in either axial direction, or it has two slip bowls, one oriented in each axial direction.

The snubbing unit is installed above an existing wellhead seal, such as that created by a blow-out preventer (BOP), and often incorporates its own seals to seal the tubular components as they are introduced or removed from the wellhead, such as through the use of a stripping head or annular. The snubbing unit may also be secured to the well head, may be supported solely by the well head or at least partly by a separately prepared structure resting on the earth around the well.

Referring again to FIG. 1, typically a pair of hydraulic cylinders, or jacking rams, are employed to move the jack head, traveling plate and traveling slip assembly of the snubbing unit in a conventional manner, and to controllably shift tubular components into and out of the well in an axial manner through a wellhead. Likewise, the various slip assemblies may be hydraulically actuated to move between an engaged and disengaged orientation; so as to engage the slip assemblies to, or disengage the slips from, any tubular component manipulated by the snubbing unit. As is conventional, the hydraulic actuated slip assemblies are generally supplied with a source of hydraulic power (e.g. hydraulic fluid under pressure) via hydraulic hoses connected to an external hydraulic power source. These hoses may be referred to as slip hydraulic hoses, because they provide hydraulic power to the slips (as opposed to providing hydraulic power to the jacking rams).

Referring once more to FIG. 1, it is also typical that, during wellbore operations when using a snubbing unit, the tubular component or drill string may need to be rotated; e.g. to rotate the string down. For example, the jack head may carry a powered rotary table wherein a rotary motor rotates the travelling slip assembly that is supported on the traveling plate via a bearing or the like. For example, and referring to FIG. 1, rotary motor may drive a gear in the direction labeled R. The rotary motor's gear then drives a gear on the rotary table to drive the traveling slip assembly in the direction labeled R'. If the traveling slip assembly has engaged a tubular, then the tubular would also be rotated in direction labeled R'.

However, in such a case, and to avoid the traveling slip assembly's hydraulic hoses from wrapping all around the snubbing unit and tubulars, these hoses are normally disconnected from the slip assemblies after the slip assembly is set (e.g. after the slips are closed onto the tubular components). With these hydraulic hoses disconnected and out of the way, the tubular component is then rotated as required (using the rotary motor). Once the tubular has been rotated as desired, the hydraulic hoses are then reconnected to the slip assemblies, to actuate the slip assemblies again as desired (e.g. to open up the slips and release the tubular component).

This disconnecting and reconnecting of the hydraulic hoses, to and from the slip assemblies, is a very time consuming and laborious task. Therefore, what is needed is a system or apparatus to reduce or eliminate the need disconnect and reconnect these hydraulic hoses when needing to rotate the tubular components.

BRIEF SUMMARY OF THE INVENTION

In accordance with one aspect of an embodiment of the invention there is provided an apparatus to transmit hydraulic force to a snubbing unit's traveling slip assembly. The apparatus comprises a first hydraulic power source having a hydraulic connection to the traveling slip assembly, a hydraulic power source actuator to actuate the hydraulic power source to cause it to transmit hydraulic force to or from the traveling slip assembly. Rotation isolation means are provided to rotationally isolate the hydraulic power source actuator from the first hydraulic power source, and to transfers axial and radial loads between the hydraulic power source actuator 65 and the first hydraulic power source. The first hydraulic power source is mounted to the traveling slip assembly so as to co-rotate therewith.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1:
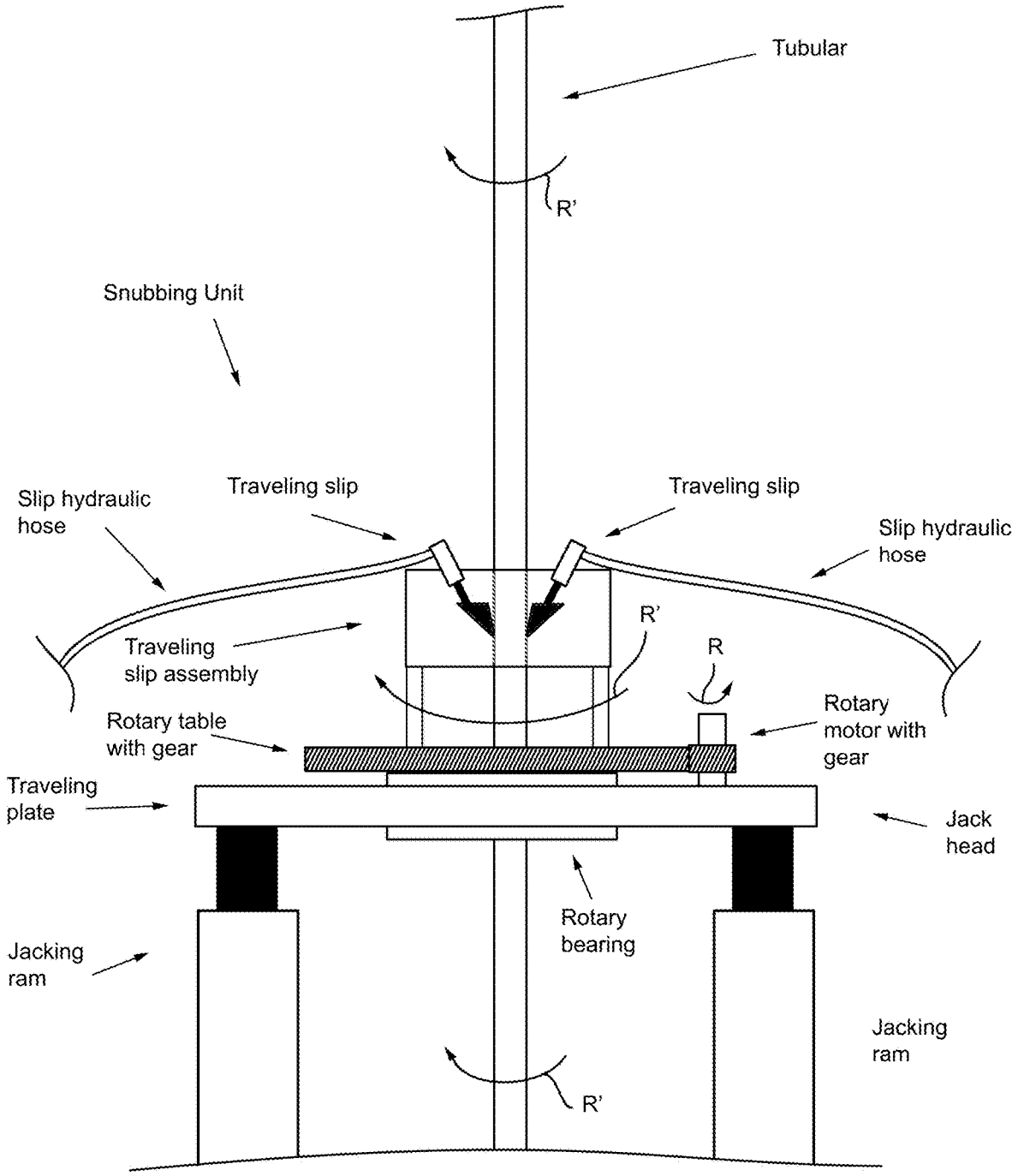
Fig. 1 PRIOR ART
FIG. 1 is a side view of a PRIOR ART traveling slip assembly on a snubbing unit.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Figure 2A:
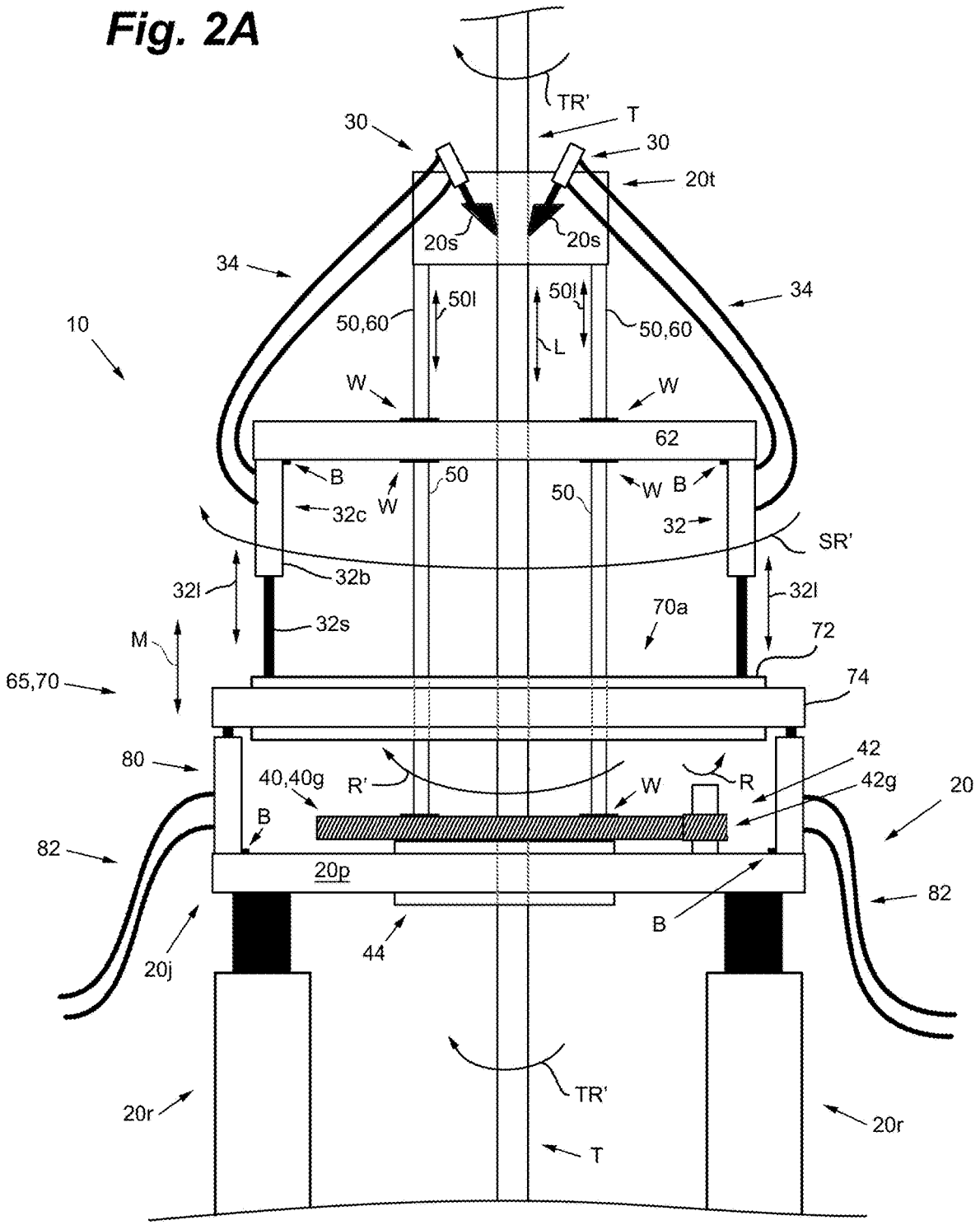
FIG. 2A is a side view of one embodiment of the invention, showing the traveling slip assembly closed onto a tubular component.

FIGS. 2A-7 show preferred embodiments of the invention 10 for use with a snubbing unit 20. In FIGS. 2A and 2B a preferred embodiment the invention is shown comprising an apparatus 10 to transmit hydraulic force to a snubbing unit's traveling slip assembly 20*t*, including during rotation of that traveling slip relative to the snubbing unit's jack head 20*j*.

In FIGS. 2A-7, the snubbing unit 20 preferably comprises a stationary slip assembly (not shown) and a traveling slip assembly 20*t*. The stationary and traveling slip assemblies are preferably opposingly oriented, to releasably and controllably shift a tubular component, or more simply referred to as tubular T, into and out of a well (not shown) in a conventional manner. The traveling slip assembly 20*t* is preferably supported by a jack head 20*j*, which may be a traveling plate 20*p*. The invention 10 and the snubbing unit 20 may be made of any suitable material of sufficient strength and durability to support the loads and forces placed thereupon, such as steel or metal.

The snubbing unit 20 may be installed above an existing wellhead seal (not shown), such as that created by a blowout preventer (BOP), and may incorporates its own seals (not shown) to seal the tubulars as they are introduced or removed from the wellhead (not shown). A pair of hydraulic cylinders, or jacking rams 20*r*, are preferably provided to move the jack head 20*j*, traveling plate 20*p* and traveling slip assembly 20*t* of the snubbing unit 20 in a conventional manner, so as to controllably shift tubular components T into and out of a well in an axial manner, i.e. substantially along the tubular's longitudinal axis L.

To be able to rotate the traveling slip assembly 20*t*, while also supporting it, the jack head 20*j* preferably carries a rotary table 40 having a first gear 40*g* mounted around, and integral with, its periphery. Jack head 20*j* also preferably comprises at least one rotary motor 42 having a second gear 42*g* which meshes with the first gear 40*g*, so as to transmit rotational motion from the rotary motor 42 to the rotary table 40 in a conventional manner. Preferably, the rotary table 40 is supported on the jack head 20*j* and/or traveling plate via a rotary bearing 44.

Figure 2B:
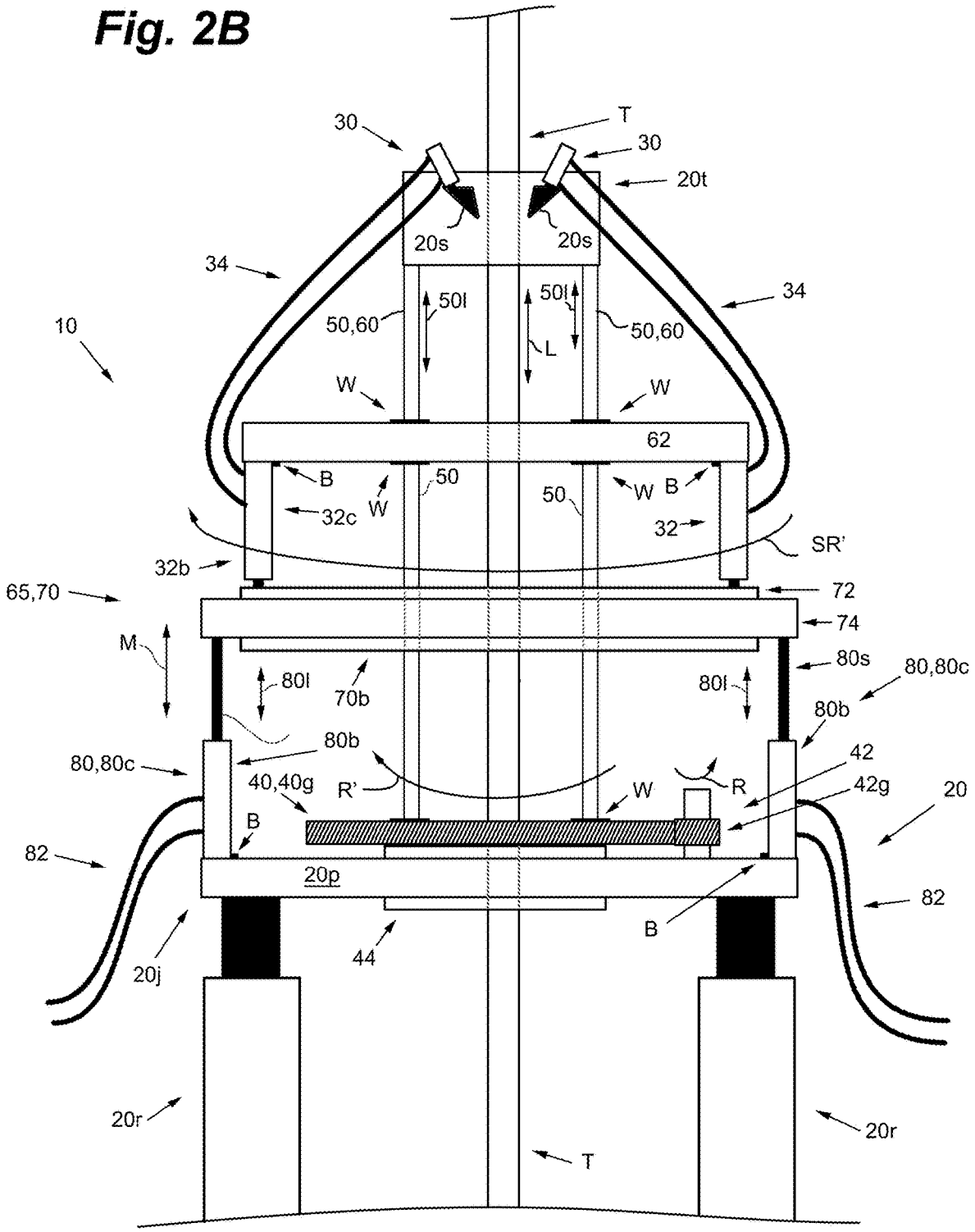
FIG. 2B is a side view of one embodiment of the invention, showing the traveling slip assembly opened and no longer engaged onto a tubular component.
Figure 3:
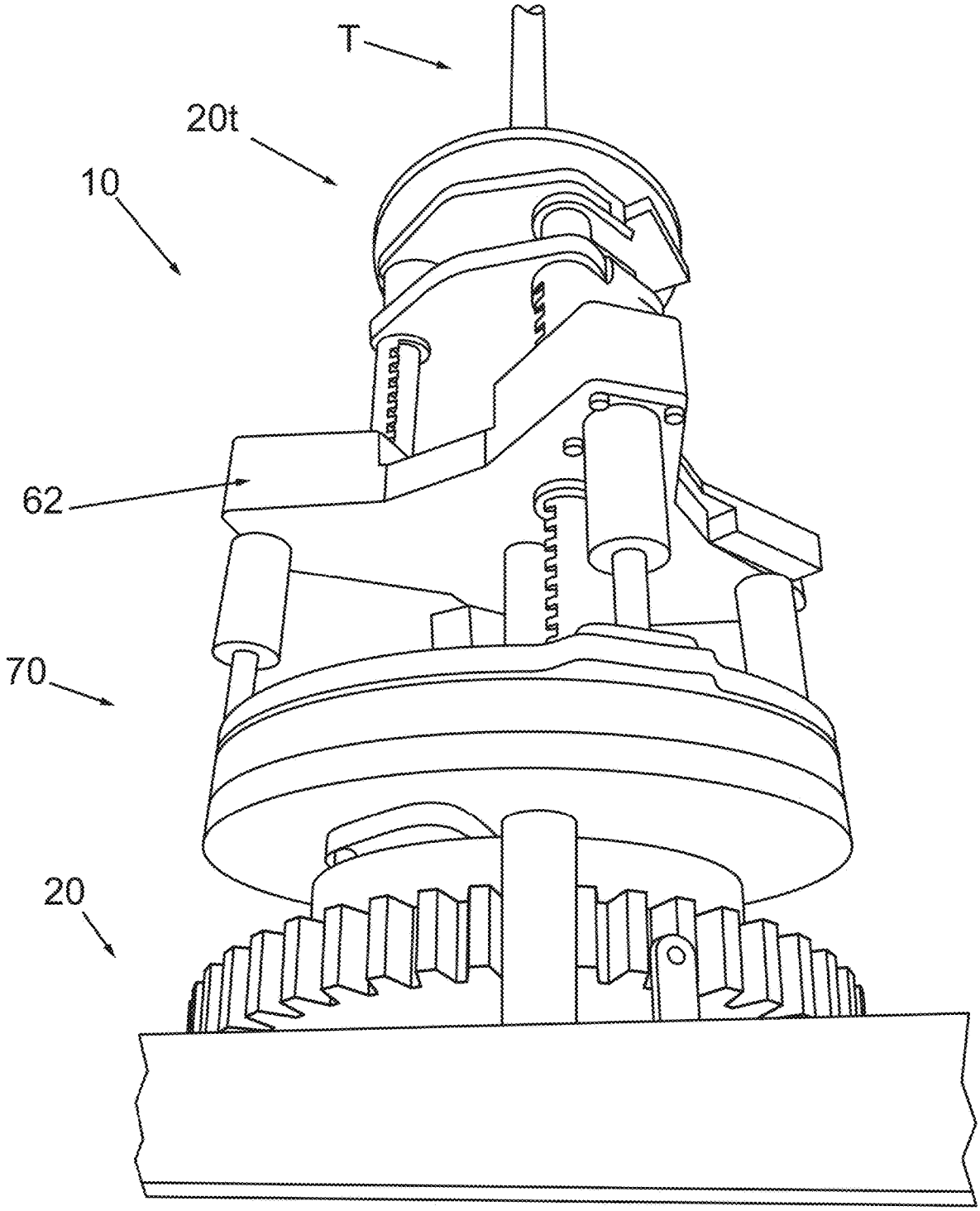
FIG. 3 is a perspective view of another embodiment of the invention.
Figure 4:
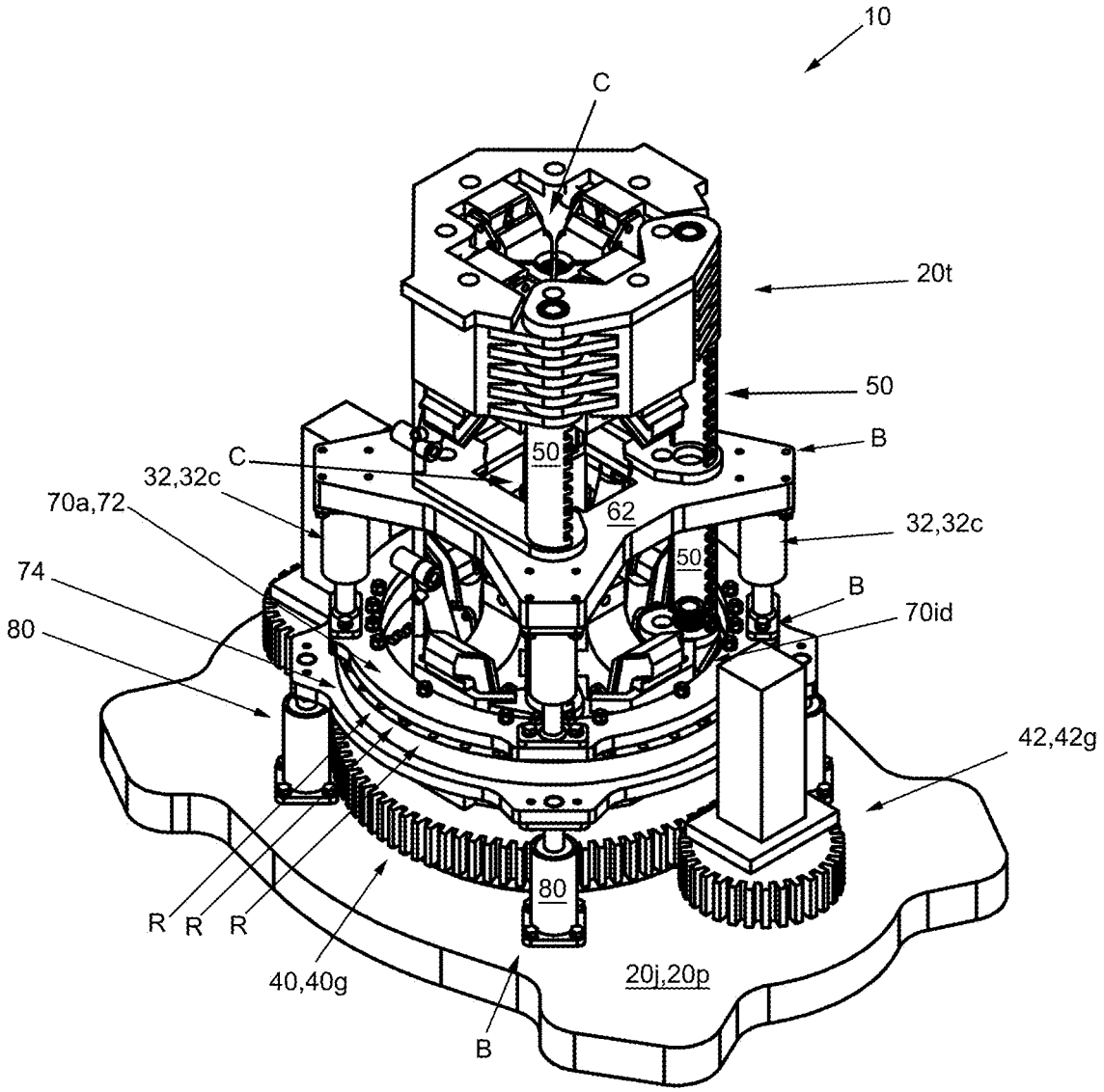
FIG. 4 is a perspective view of yet another embodiment of the invention.
Figure 5:
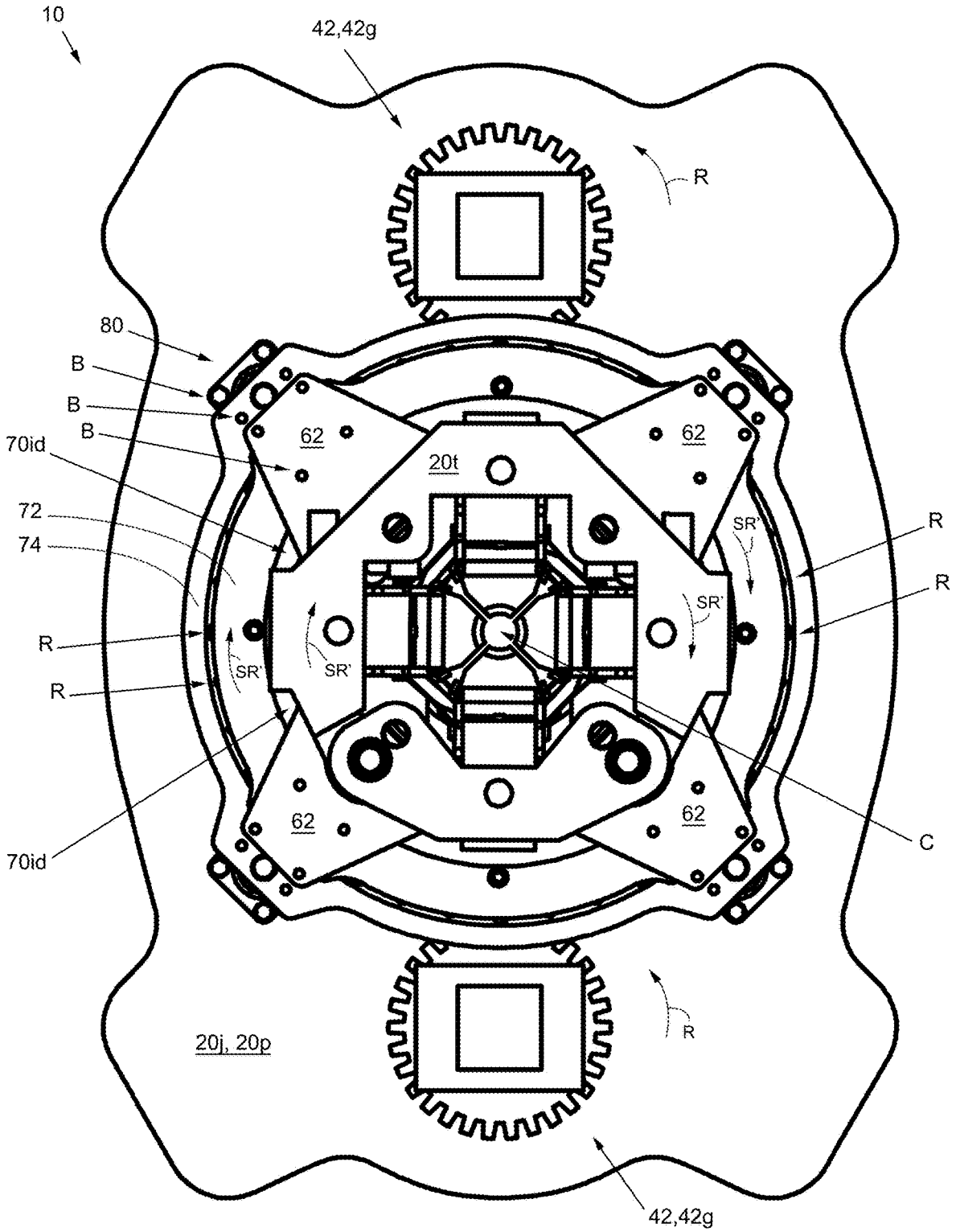
FIG. 5 is a top view of the embodiment of the invention of FIG. 4.
Figure 6:
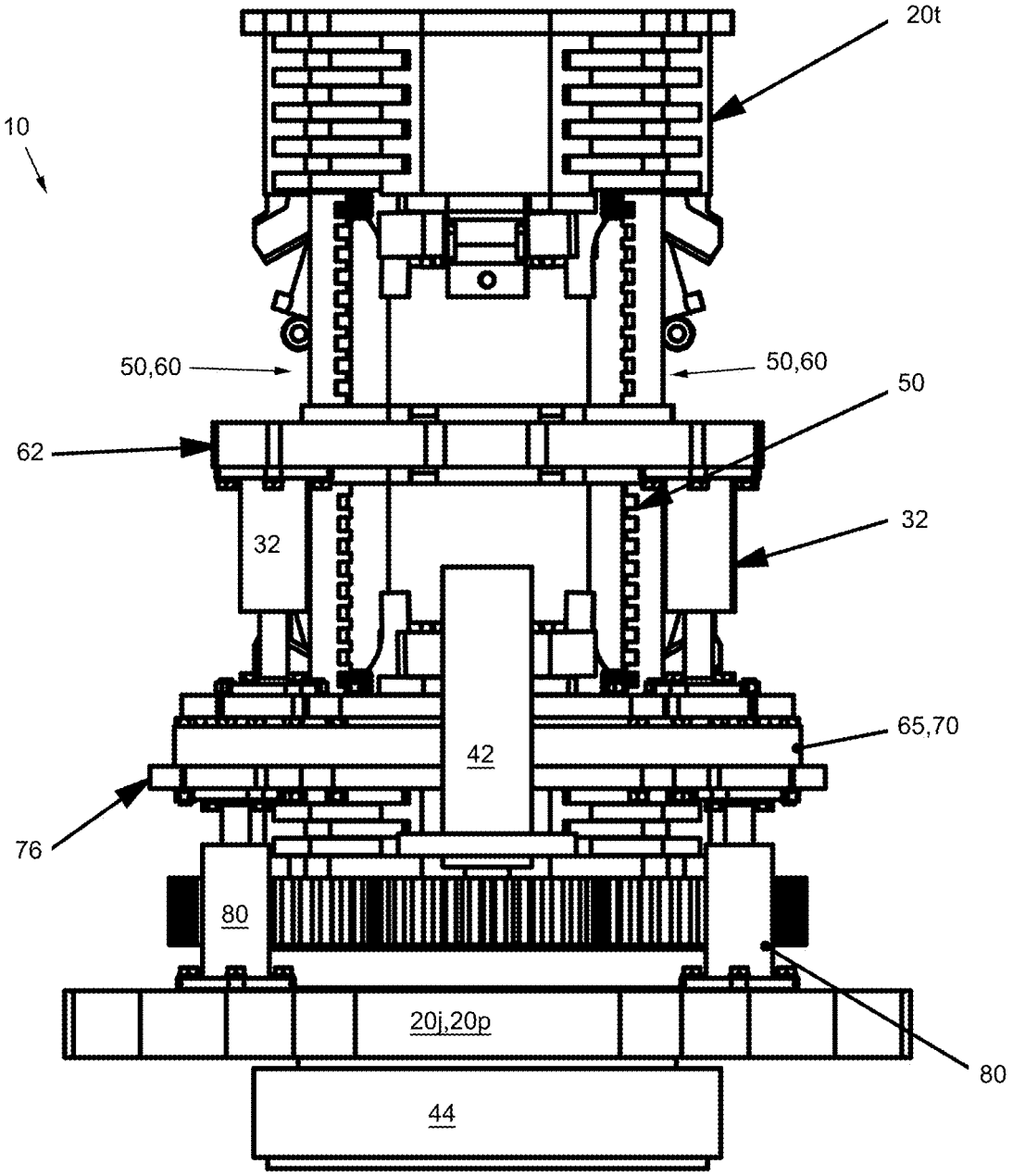
FIG. 6 is a side view of the embodiment of the invention of FIG. 4.
Figure 7:
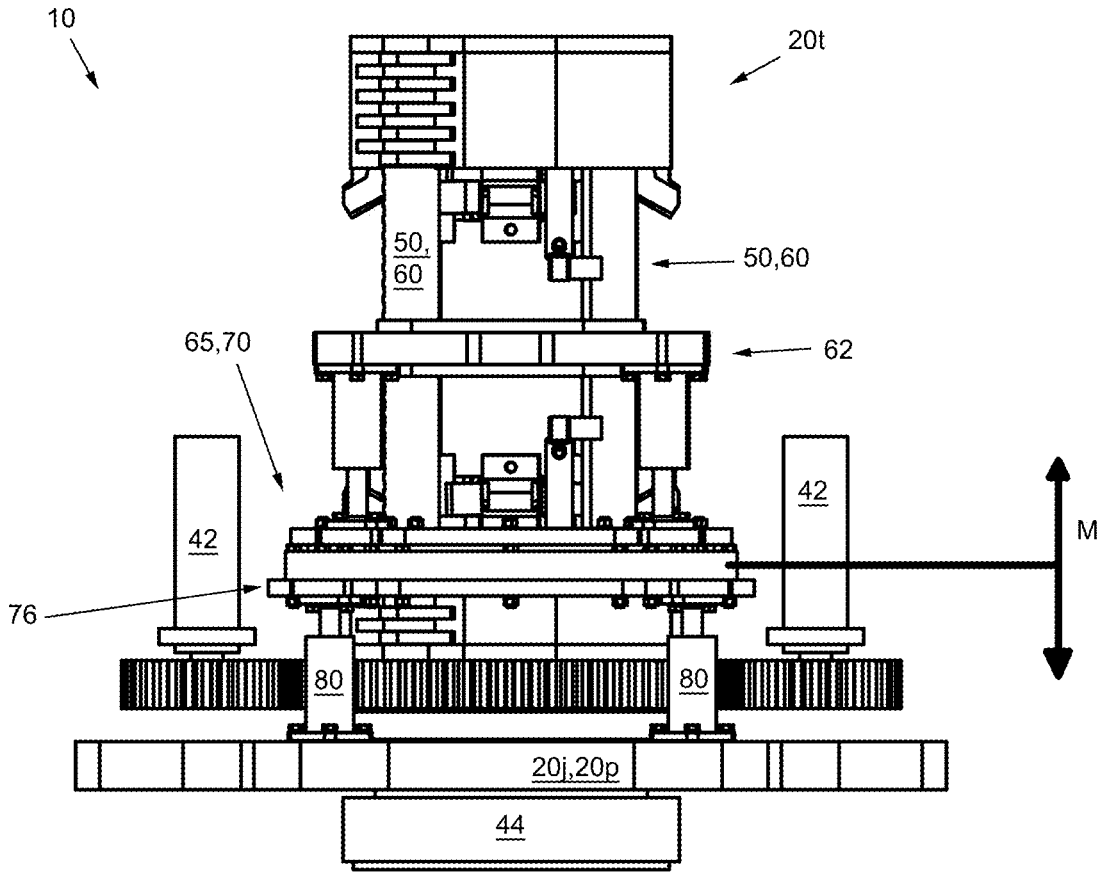
FIG. 7 is a front view of the embodiment of the invention of FIG. 4.

Traveling slip assembly 20*t* may be connected or mounted directly onto the rotary table 40, or the traveling slip assembly 20*t* may be mounted to the rotary table 40 by means of connecting members or legs 50 (as more clearly shown in FIGS. 2A and 2B). Preferably the connecting members 50 are a longitudinal member having a longitudinal axis 50*l*. More preferably, the connecting members 50 are mounted to the rotary table 40 so that they are outside of, and lateral to, any tubular T positioned within the snubbing unit 20, and so that their longitudinal axis 50*l* are aligned substantially parallel to the longitudinal axis L of the tubular T. Accordingly, as rotating table 40 is rotated, the traveling slip assembly 20*t* will rotate therealong with.

For example, rotary motor 42 may drive the second gear 42*g* in the direction labeled R, thereby then driving the first gear 40*g* and the rotary table 40 in the direction labeled R' (see FIGS. 2A and 2B). If the traveling slip assembly 20*t* has engaged a tubular T, then the tubular T will also be co-rotated in direction labeled TR' (see FIG. 2A). If the traveling slip assembly 20*t* has disengaged form the tubular T, then rotation of the rotary table 40 and traveling slip assembly 20*t* will not rotate the tubular T (see FIG. 2B).

Preferably, the traveling slip assembly 20*t* is hydraulically actuated in a conventional manner, having one or more hydraulic actuators 30 to move the individual slips 20*s* between an engaged (see FIG. 2A) and disengaged (see FIG. 2B) orientation; i.e. so as to engage the slips 20*s* to, or disengage the slips 20*s* from, any tubular T manipulated by the snubbing unit 20. A first source of hydraulic power 32 (e.g. hydraulic fluid under pressure) is provided to the hydraulic actuators 30 of the traveling slip assembly 20*t*, preferably via a hydraulic connection comprised of one or more or more short hydraulic hoses 34. The first hydraulic power source 32, and any hoses 34, are mounted to the traveling slip assembly 20*t* so as to co-rotate therewith (e.g. in direction SR' as shown in FIGS. 2A and 2B).

The first hydraulic power source 32 may be connected or mounted directly onto the traveling slip assembly 20*t*. Or the first hydraulic power source 32 may be mounted to the traveling slip 20*t* by means of intermediary connecting members 60 (as shown in FIGS. 2A and 2B). Intermediary connecting members 60 may be comprised of a first load plate 62 connected to the traveling slip assembly 20*t* via connecting members 50. The first hydraulic power source 32 and connecting members 50 may be connected to first load plate 62 in any number of conventional ways, including via bolt means B or via welds W. The remaining components of the invention 10 may likewise be connected in any number of conventional ways, including via bolt means B or via welds W. Accordingly, as rotating table 40 is rotated (in direction R'), the traveling slip assembly 20*t*, the connecting members 50, any intermediary connecting members 60 (including first load plate 62), the hoses 34 and the first hydraulic power source 32 will co-rotate therealong with (e.g. in direction SR' as shown in FIGS. 2A and 2B). Advantageously, since the hoses 34 now co-rotate along with the traveling slip assembly 20*t*, these hoses 34 are prevented from wrapping all around the snubbing unit 20 and tubulars T, and these hoses 34 no longer need to be disconnected and reconnected to/from the slip assemblies 20*t*.

In a preferred embodiment of the invention 10, the hydraulic power source 32 may be a first set of one or more conventional hydraulic ram cylinders 32*c* comprised of a shaft 32*s* having a longitudinal axis 32*l* capable of moving an interior sealed piston within a cylinder or barrel 32*b* that contains a predetermined amount of hydraulic fluid. Preferably the one or more first set of hydraulic ram cylinders 32*c* are mounted to the first load plate 62 so that their longitudinal axis 32*l* are aligned substantially parallel to the longitudinal axis L of the tubular T, as the tubular T is positioned within the snubbing unit 20. The hydraulic power source 32 is actuated by moving the shafts 32*s* into, and out of, the barrel 32*b* so as to move the piston along the interior of the barrel 32*b* and deliver hydraulic fluid along hoses 34 into our out of the hydraulic actuators 30. In this sense, first set of hydraulic ram cylinders 32*c* act as a hydraulic pump—actuating actuators 30 and moving slips 20*s* back and forth as desired.

The invention 10 further comprises hydraulic power source actuator 65 to reciprocally move the shafts 32*s* into, and out of, the barrel 32*b* of the first set of hydraulic ram cylinders 32*c* as may be desired. Hydraulic power source actuator 65 thereby actuates the hydraulic power source 32, causing it to deliver or receive hydraulic fluid to/from the hydraulic actuators 30 in the traveling slip assembly 20*t*—actuating slip assembly 20*t* between an engaged and disengaged orientation. In a preferred embodiment, hydraulic power source actuator 65 comprises an actuator bearing 70 and a second set of hydraulic ram cylinders 80 to move the actuator bearing 70, as further explained below.

Second set of hydraulic ram cylinders 80 are preferably a set of one or more conventional hydraulic ram cylinders 80*c* comprised of a shaft 80*s* having a longitudinal axis 80*l* capable of moving an interior sealed piston within a cylinder or barrel 80*b* that contains a predetermined amount of hydraulic fluid. Preferably the one or more first set of hydraulic ram cylinders 80*c* are mounted between the actuator bearing 70 and jack head 20*j* so that their longitudinal axis 80*l* are aligned substantially parallel to the longitudinal axis L of the tubular T, as the tubular T is positioned within the snubbing unit 20; for example as shown in FIGS. 2A and 2B.

Since the second set of hydraulic ram cylinders 80 are mounted to the jack head 20*j*, they therefore remain stationary relative to any traveling slip assembly rotation (i.e. cylinders 80 remain stationary along with the jack head 20*j*). Second set of hydraulic ram cylinders 80 may be provided with a source of hydraulic power (not shown), and be actuated, in a conventional manner, such as via a second set of hydraulic hoses 82. Advantageously, because the second set of hydraulic ram cylinders 80 remain stationary (relative to any rotation of the traveling slip), the second set of hydraulic hoses 82 are not at risk of becoming wrapped all around the snubbing unit 20 and tubulars T.

As mentioned, the actuator bearing 70 is preferably positioned between the first load plate 62 and the jack head 20*j*. Actuator bearing 70 comprises an inside opening or passage with an inside diameter 70*id* of sufficient size and dimensions to allow bearing 70 to be positioned around any connecting members 50, any slip assemblies and any tubulars T as they may be positioned within the snubbing unit 20 (e.g. see FIG. 4). Actuator bearing 70 may be a slewing bearing, and may be made of any suitable material of sufficient strength and durability to support the loads and forces placed thereupon, such as steel or metal.

As is conventional, actuator bearing 70 comprises an inner race 72 and an outer race 74 and presents two generally opposing faces 70*a* and 70*b*. One of the races may be the turning race (e.g. inner race 72 in FIGS. 2A and 2B), and the other race may be the stationary race (e.g. outer race 74 in FIGS. 2A and 2B). Rolling elements R, such as rollers or balls with a circular cross-section, are preferably located between the races 72, 74. Actuator bearing 70 may also be supported by a second load plate 76 (e.g. see FIG. 6) and the second set of hydraulic ram cylinders 80 may then be mounted between the jack head 20*j* and the second load plate 76 (see FIGS. 6 and 7).

Preferably, the first set of hydraulic ram cylinders 32*c* are mounted between the first load plate 62 and to one of the races of the actuator bearing 70 at a first face of the bearing 70 (e.g. to the inner race 72 and to face 70*a*, as shown in FIG. 2A). More preferably, the second set of hydraulic ram cylinders 80 are mounted between the jack head 20*j* and another race of the actuator bearing 70 at a second, opposing face of the bearing 70 (e.g. to the outer race 74 and to second face 70*b*, as shown in FIG. 2B). Even more preferably, the longitudinal axis 32*l*, 80*l* of each of the first and second sets of hydraulic ram cylinders 32*c*, 80 are aligned substantially parallel to each other, so that an extension of one set of hydraulic ram cylinders (e.g. 80) will result in a corresponding retraction or shortening of the other set of hydraulic ram cylinders (e.g. 32*s*).

Actuator bearing 70 is movable between the first load plate 62 and the jack head 20*j* along the longitudinal axis 50*l*, L of any connecting members 50 and any tubulars T that may be within its inner diameter passage 70*id*, and as indicated by the arrow labeled M in the figures (compare FIG. 2A to 2B). Actuator bearing 70 rotationally isolates the first set of hydraulic ram cylinders 32*c* from the second set of hydraulic ram cylinders 80, but still transfers axial and radial loads from one set to the other set. This is because each set of hydraulic ram cylinders 32*c*, 80 is mounted to a different face and a different race of the bearing 70; e.g. first set 32*c* is mounted to inner race 72 at face 70*a*, while second set 80 is mounted to the outer race 74 at opposing face 70*b*. As such, actuator bearing 70 may also be referred to rotation isolation means 70, since it functions to rotationally isolate the first hydraulic power source 32 from the hydraulic power source actuator 65. Rotation isolation means can also comprise other types of bearings, other than a slewing bearing.

Additionally, and because each of the longitudinal axis 32*l*, 80*l* of each of the sets of hydraulic ram cylinders 32*c*, 80 are aligned substantially parallel to each other (and to the longitudinal axis L, 50*l* of any tubulars T or connecting members), axial forces are readily transmitted between each set of hydraulic ram cylinders 32*c*, 80; all while each of the sets of hydraulic ram cylinders 32*c*, 80 are rotationally isolated from each other. Since traveling slip assembly 20*t* and hydraulic actuator are axially restrained relative to the jack head 20*j* (by means of connecting members 50, rotary table 40 and rotary member 42), substantially all axial forces will be transmitted between each set of hydraulic ram cylinders 32*c*, 80 as they are reciprocated back and forth. Advantageously, a force F may be generated by one set of hydraulic ram cylinders (e.g. by second set 80). That set of cylinders 80 can be kept stationary (relative to the jack head 20*j*), while at the same time the actuator bearing 70 transmits the axial component of that force to the other set of hydraulic ram cylinders (e.g. to first sect 32*c*); thereby then actuating hydraulic actuator 30. Each set of cylinders 32*c*, 80 can now freely rotate relative to each other, while axial forces between these sets are maintained.

Advantageously, the actuator bearing 70 allows for hoses 34 to co-rotate with the traveling slip assembly 20*t* (e.g. in direction SR'), and for hoses 84 to remain stationary relative to any traveling slip assembly rotation (e.g. remain stationary along with the jack head 20*j*). Even more advantageously, and as is now explained, hydraulic actuation of the traveling slip assembly 20*t* may be accomplished without the need to connect/disconnect hydraulic hoses to/from the snubbing unit 20 and without hoses becoming wrapped all around the snubbing unit 20 and tubulars T. This is because hoses 82 do not rotate and can connect to a hydraulic source of power that is outside of the snubbing unit, while hoses 34 co-rotate with the traveling slip assembly 20*t* (but are not required to connect to a hydraulic source of power that is outside of the snubbing unit.

As is shown in the figures, and as will be understood by those skilled in the art, all of: the traveling slip assembly 20*t*, the first load plate 62, the second load plate 76, the actuator bearing 70, the rotary table 40, the rotary bearing 44, the jack head 20*j* and the traveling plate 20*p* will each have a central passage C of sufficient diameter to allow passage of the tubular T therethrough.

As will now also be understood by those skilled in the art, hydraulic actuator 30, hydraulic power source 32, hoses 34, 82, and first and second sets of hydraulic ram cylinders 32*c*, 80 can be specified in a conventional manner (and provided with sufficient hydraulic fluid and capacity) so as to actuate the slips 20*s* between an engaged (FIG. 2A) and disengaged (FIG. 2B) orientation onto, or off of, the tubular T; i.e. when the actuator 65 and actuator bearing 70 are moved between a first position (e.g. FIG. 2A) and a second position (e.g. FIG. 2B) along longitudinal axis L.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. An apparatus to transmit hydraulic force to a traveling slip assembly of a snubbing unit, the apparatus comprising:

a first hydraulic power source (32) having a hydraulic connection to the traveling slip assembly; and a hydraulic power source actuator (65) to actuate the hydraulic power source (32) to cause the hydraulic power source (65) to transmit hydraulic force to or from the traveling slip assembly, said hydraulic power source actuator (65) further comprising a rotation isolation means;

wherein the rotation isolation means rotationally isolates the hydraulic power source actuator (65) from the first hydraulic power source (32) and transfers axial and radial loads between the hydraulic power source actuator (65) and the first hydraulic power source (32); and wherein the first hydraulic power source (32) is mounted to the traveling slip assembly so as to co-rotate therewith.

2. The apparatus of claim 1 wherein the first hydraulic power source comprises at least one first hydraulic ram cylinder (32*c*).

3. The apparatus of claim 2 wherein the at least one first hydraulic ram cylinder (32*c*) comprises a shaft (32*s*) having a longitudinal axis (32*l*) capable of moving an interior sealed piston within a cylinder (32*b*) that contains a predetermined amount of hydraulic fluid.

4. The apparatus of claim 3 wherein the at least one first hydraulic ram cylinder £32*c*) is mounted within the apparatus so that a longitudinal axis (32*l*) of the at least one hydraulic ram cylinder is aligned substantially parallel to a longitudinal axis (L) of any tubular (T) that is configured to be positioned within the snubbing unit.

5. The apparatus of claim 3 wherein the hydraulic power source actuator (65) actuates the hydraulic power source by reciprocally moving the shaft (32*s*) into, and out of, the barrel (32*b*).

6. The apparatus of claim 2 wherein the rotation isolation means is an actuator bearing (70).

7. The apparatus of claim 2 wherein the hydraulic power source actuator (65) further comprises a second set of hydraulic ram cylinders (80).

8. The apparatus of claim 7 wherein the rotation isolation means is an actuator bearing (70); and wherein the second set of hydraulic ram cylinders (80) are operable to move the actuator bearing (70).

9. The apparatus of claim 8 wherein the actuator bearing (70) rotationally isolates the at least one first hydraulic ram cylinder (32*c*) from the at least one second hydraulic ram cylinder (80), but still transfers axial and radial loads between the at least one first hydraulic ram cylinder (32*c*) and the at least one second hydraulic ram cylinder (80).

10. The apparatus of claim 9 wherein the actuator bearing (70) has a central passage of sufficient diameter to allow passage therethrough of any tubular (T) that is configured to be positioned within the snubbing unit.

11. The apparatus of claim 1 wherein the hydraulic connection to the traveling slip assembly comprises at least one hydraulic hose (34) to transmit hydraulic force from the first hydraulic power source (32) to the travelling slip assembly.

12. The apparatus of claim 11 wherein, when the traveling slip assembly rotates, the at least one hydraulic hose (34) co-rotates therewith.

13. An apparatus to transmit hydraulic force to a traveling slip assembly of a snubbing unit, the apparatus comprising:

a first hydraulic power source (32) having a hydraulic connection to the traveling slip assembly; and a hydraulic power source actuator (65) to actuate the hydraulic power source (32) to cause the hydraulic power source (65) to transmit hydraulic force to or from the traveling slip assembly, said hydraulic power source actuator (65) further comprising an actuator bearing (70);

wherein the actuator bearing (70) rotationally isolates the hydraulic power source actuator (65) from the first hydraulic power source (32), and transfers axial and radial loads between the hydraulic power source actuator (65) and the first hydraulic power source (32); and wherein the first hydraulic power source (32) is mounted to the traveling slip assembly so as to co-rotate therewith.

14. The apparatus of claim 13 wherein the first hydraulic power source comprises at least one first hydraulic ram cylinder (32*c*).

15. The apparatus of claim 14 wherein the at least one first hydraulic ram cylinder (32*c*) comprises a shaft (32*s*) having a longitudinal axis (32*l*) capable of moving an interior sealed piston within a cylinder (32*b*) that contains a predetermined amount of hydraulic fluid.

16. The apparatus of claim 15 wherein the at least one first hydraulic ram cylinder (32*c*) is mounted within the apparatus so that a longitudinal axis (32*l*) of the at least one hydraulic ram cylinder is aligned substantially parallel to a longitudinal axis (L) of any tubular (T) that is configured to be positioned within the snubbing unit.

17. The apparatus of claim 15 wherein the hydraulic power source actuator (65) actuates the hydraulic power source by reciprocally moving the shaft (32*s*) into, and out of, the barrel (32*b*).

18. The apparatus of claim 14 wherein the hydraulic power source actuator (65) further comprises a second set of hydraulic ram cylinders (80); and wherein the second set of hydraulic ram cylinders (80) are operable to move the actuator bearing (70).

19. The apparatus of claim 18 wherein the actuator bearing (70) rotationally isolates the at least one first hydraulic ram cylinder (32*c*) from the at least one second hydraulic ram cylinder (80), but still transfers axial and radial loads between the at least one first hydraulic ram cylinder (32*c*) and the at least one second hydraulic ram cylinder (80).

20. The apparatus of claim 19 wherein the actuator bearing (70) has a central passage of sufficient diameter to allow passage therethrough of any tubular (T) that is configured to be positioned within the snubbing unit;

wherein the hydraulic connection to the traveling slip assembly comprises at least one hydraulic hose (34) to transmit hydraulic force from the first hydraulic power source (32) to the travelling slip assembly; and wherein, when the traveling slip assembly rotates, the at least one hydraulic hose (34) co-rotates therewith.

* * * * *